US007779736B2

(12) United States Patent
Liu et al.

(10) Patent No.: US 7,779,736 B2
(45) Date of Patent: Aug. 24, 2010

(54) MITER SAW HAVING SECURABLE POSITIONING STRUCTURE FOR BLADE GUARD THEREOF

(75) Inventors: Chia-Sheng Liu, Chiayi County (TW); Yi-Li Cheng, Taichung County (TW)

(73) Assignee: Durq Machinery Corp., Taichung (TW)

( * ) Notice: Subject to any disclaimer, the term of this patent is extended or adjusted under 35 U.S.C. 154(b) by 334 days.

(21) Appl. No.: 12/081,259

(22) Filed: Apr. 14, 2008

(65) Prior Publication Data

US 2009/0223339 A1 Sep. 10, 2009

(30) Foreign Application Priority Data

Mar. 5, 2008 (TW) ..... 97107745 A

(51) Int. Cl.
*B26D 1/18* (2006.01)

(52) U.S. Cl. ..... 83/397; 83/490; 83/478

(58) Field of Classification Search ..... 83/490, 83/483, 471.3, 478, 469, 676, 397–398, 477.2; 30/391

See application file for complete search history.

(56) References Cited

U.S. PATENT DOCUMENTS 3,613,748 A * 10/1971 De Pue ..... 30/391
5,075,976 A * 12/1991 Young ..... 30/391
5,129,300 A * 7/1992 Kawakami ..... 83/471.2
5,638,731 A * 6/1997 Garuglieri ..... 83/397
5,724,875 A * 3/1998 Meredith et al. ..... 83/397
5,752,421 A * 5/1998 Chang ..... 83/397
5,787,779 A * 8/1998 Garuglieri ..... 83/397
5,957,021 A * 9/1999 Meredith et al. ..... 83/397
5,960,691 A * 10/1999 Garuglieri ..... 83/471.2
6,415,699 B1 * 7/2002 Bettacchini et al. ..... 83/397
6,758,122 B2 * 7/2004 Kao ..... 83/379
6,994,007 B2 * 2/2006 Kenyon et al. ..... 83/468.7
7,121,179 B2 * 10/2006 Chen ..... 83/522.16
7,426,787 B2 * 9/2008 Tracy et al. ..... 30/391
7,631,587 B2 * 12/2009 Svetlik et al. ..... 83/471.3
2002/0134211 A1 * 9/2002 Bettacchini et al. ..... 83/397
2002/0170404 A1 * 11/2002 Peot et al. ..... 83/478
2003/0217629 A1 * 11/2003 Chen ..... 83/471.3
2006/0075866 A1 * 4/2006 Brunson ..... 83/471.3
2007/0079678 A1 * 4/2007 Rossetti et al. ..... 83/397
2007/0079679 A1 * 4/2007 Rossetti et al. ..... 83/490
2007/0101845 A1 * 5/2007 Bettacchini ..... 83/397
2007/0234864 A1 * 10/2007 Bettacchini ..... 83/471.3
2010/0077898 A1 * 4/2010 Smith et al. ..... 83/469

* cited by examiner

*Primary Examiner*—Kenneth E. Peterson
*Assistant Examiner*—Sean Michalski
(74) *Attorney, Agent, or Firm*—Bacon & Thomas, PLLC

(57) ABSTRACT

A miter saw having a securable positioning structure for a blade guard thereof includes a saw blade, a rotatable handle, a movable blade guard, a control unit, a positioning unit, and a rope. The rotatable handle is provided for the user's holding for the cutting operation. The movable blade guard is shiftable between where it covers the saw blade and where it does not cover the saw blade. The control unit is mounted to the rotatable handle. The positioning unit is provided for blocking the movement of the movable blade guard. The rope is connected with the control unit and the positioning unit. Accordingly, the user only needs to operate the control unit to drive action of the positioning unit via the rope to hold the movable blade guard in position, thus securing the safety of the operation. In addition, the rotatable handle can be turned smoothly without any barrier.

9 Claims, 11 Drawing Sheets

MITER SAW HAVING SECURABLE POSITIONING STRUCTURE FOR BLADE GUARD THEREOF

BACKGROUND OF THE INVENTION

1. Field of the Invention

The present invention relates generally to miter saws, and more particularly, to a miter saw having a securable positioning structure for a blade guard thereof.

2. Description of the Related Art

A conventional miter saw includes a bench, a blade supporting assembly having one end pivoted to the bench, a stationary handle pivoted to the other end of the bench, a saw blade pivoted to the blade supporting assembly, a stationary blade guard fastened with the blade supporting assembly and covering an upper part of the saw blade, and a movable blade guard covering a lower part of the saw blade. When the miter saw is not operated, the stationary and movable blade guards jointly cover the full part of the saw blade to prevent a user from injury resulted from accidentally touching the saw blade. However, if the blade supporting assembly is carelessly pressed downward because of some reasons, e.g. accidental touch during movement of the miter saw, to force the movable blade guard to turn back into the stationary blade guard, the lower part of the saw blade will be exposed outside to cause unsafety.

To improve the above-mentioned drawback, an improved miter saw having a stopping mechanism was invented, operated in such a way that the stopping mechanism can stop the movable blade guard while unreleased for safety. To facilitate operation, a release control switch of the stopping mechanism is mounted to the stationary handle. However, the stopping mechanism and the control switch that are applied to the stationary handle fail to be applied to the miter saw having a rotatable handle that is more and more popular with the consumers because it can meet different users' different operational customs. For this reason, the miter saw having the stopping mechanism still needs improvement in safety of operation.

SUMMARY OF THE INVENTION

The primary objective of the present invention is to provide a miter saw having a securable positioning structure for a blade guard thereof, which secures the safety of the user's operation of the miter saw having the rotatable handle.

The foregoing objective of the present invention is attained by the miter saw composed of a bench, a blade supporting assembly, a rotatable handle, a saw blade, a stationary blade guard, a movable blade guard, a positioning unit, a control unit, and a rope. The blade supporting assembly at one end is pivoted to the bench. The rotatable handle is rotatably connected with the other end of the blade supporting assembly. The saw blade is rotatably connected with one side the blade supporting assembly. The stationary blade guard is fastened with the blade supporting assembly, covering an upper part of the saw blade. The movable blade guard is movable together with the blade supporting assembly and, shiftable between a covered position and an uncovered position with respect to the stationary blade guard. The positioning unit is mounted to one side of the stationary blade guard, having a working portion and a worked portion that are jointly movable. The control unit is mounted to the rotatable handle and shiftable between a first position and a second position. The rope includes two ends, one of which is connected with the control unit and the other is connected with the worked portion. When the control unit is located at the first position, the working portion is stopped against the movable blade guard to enable the movable blade guard to cover the lower part of the saw blade. When the control unit is located at the second position, the working portion is not stopped against the movable blade guard.

DETAILED DESCRIPTION OF PREFERRED EMBODIMENTS

Figure 1:
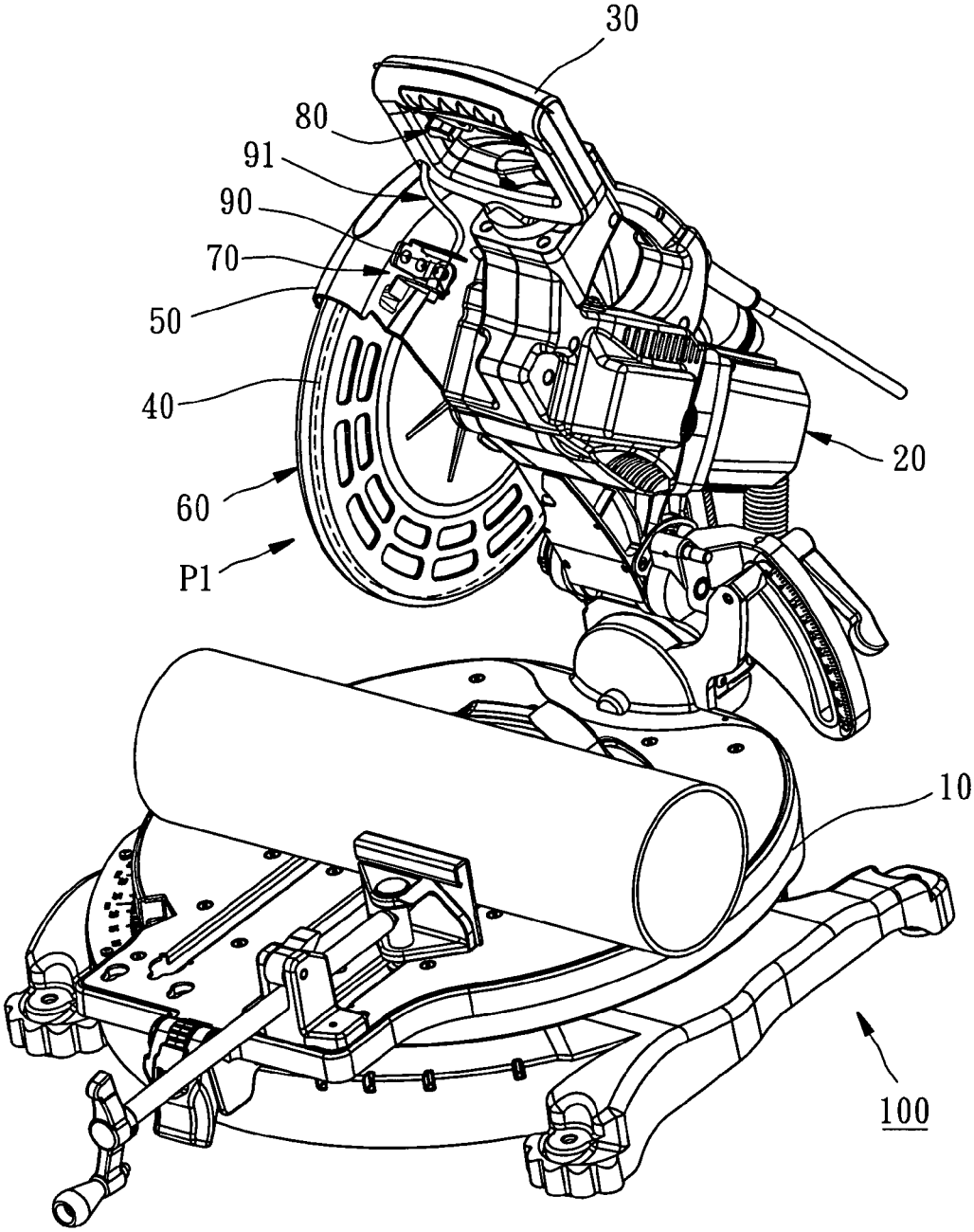
FIG. 1 is a perspective view of a preferred embodiment of the present invention.
Figure 2:
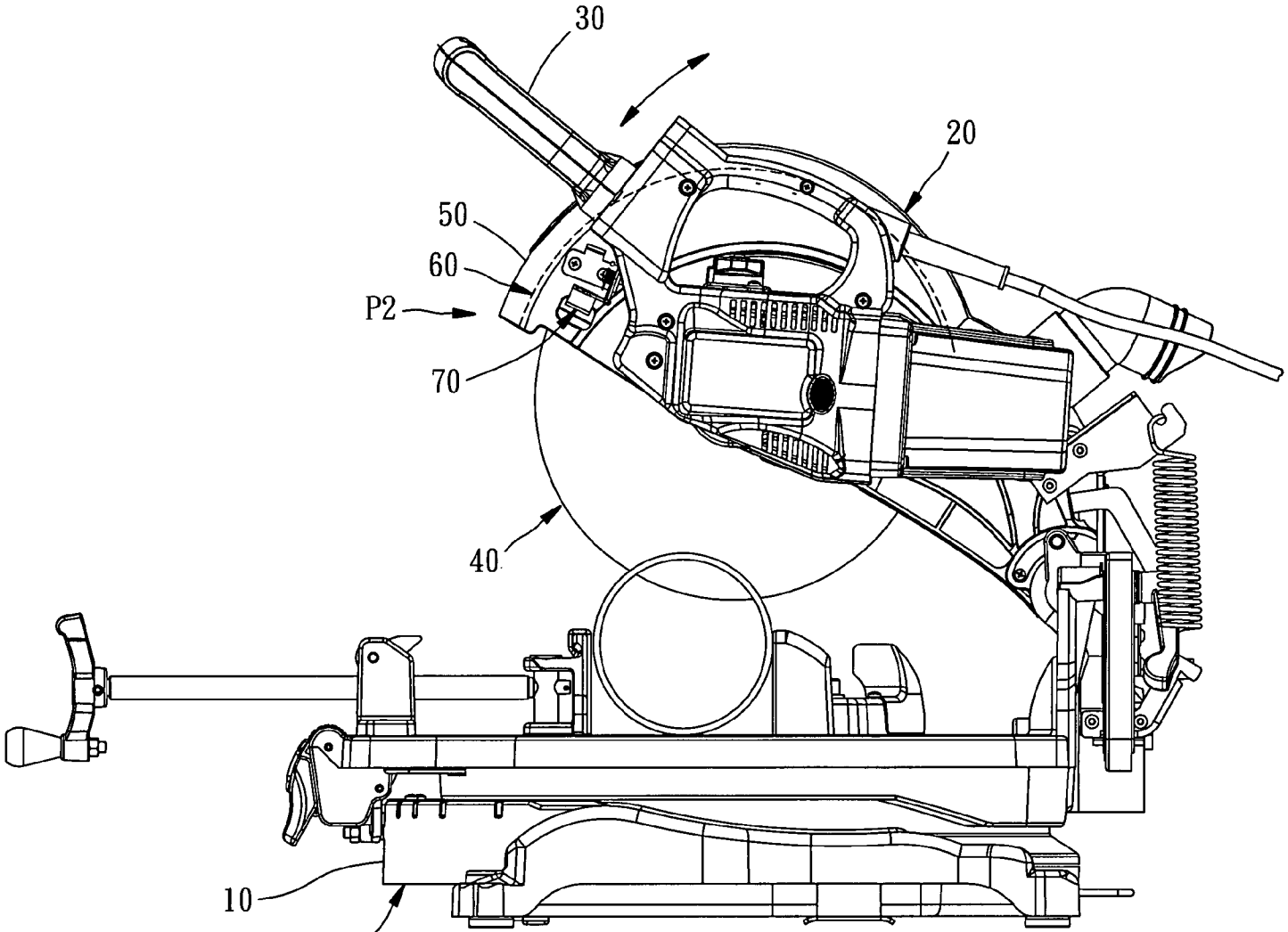
FIG. 2 is a side view of the preferred embodiment of the present invention, illustrating that the blade supporting assembly is pressed downward.
Figure 3:
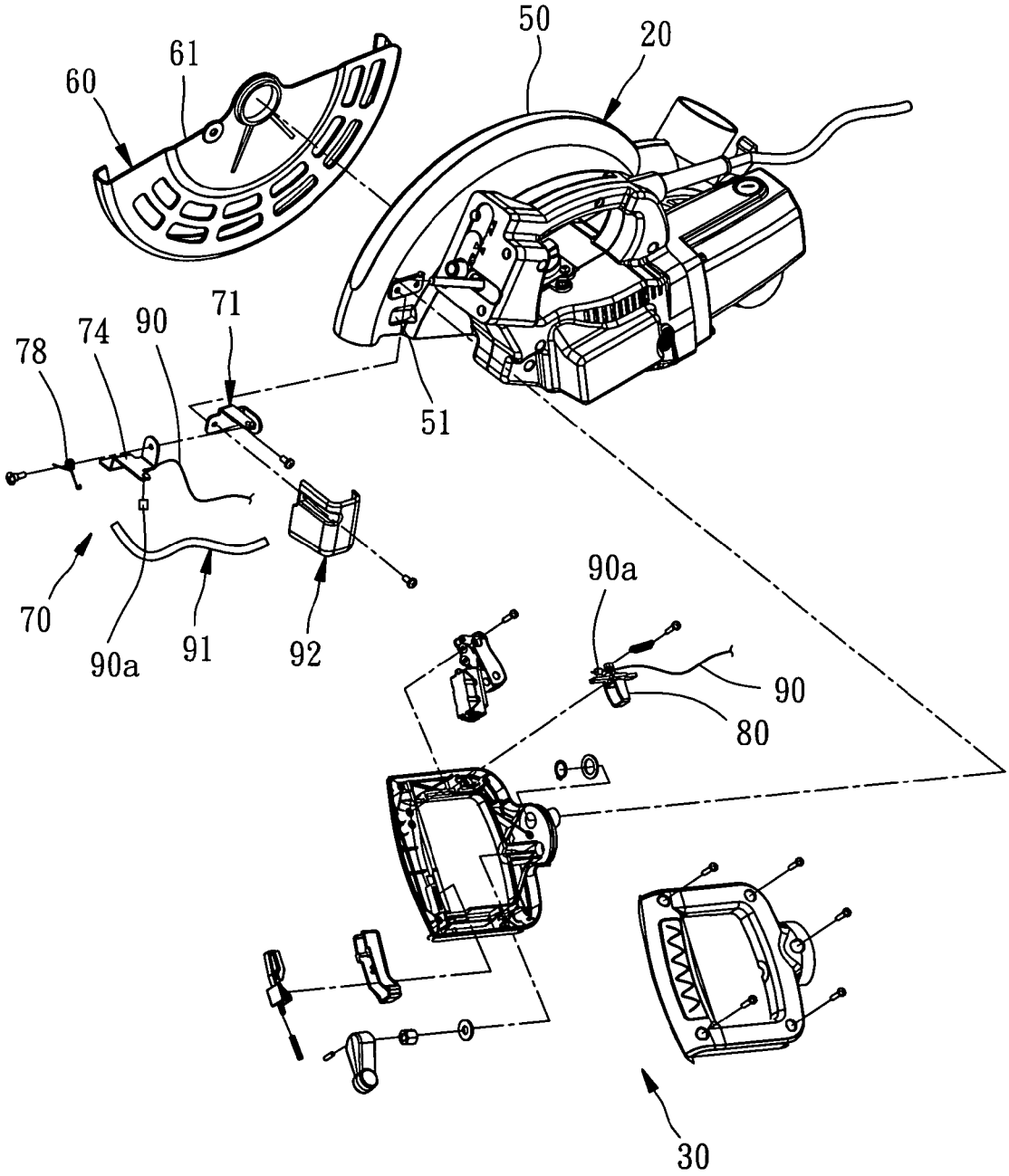
FIG. 3 is an exploded view of parts of the preferred embodiment of the present invention.
Figure 4:
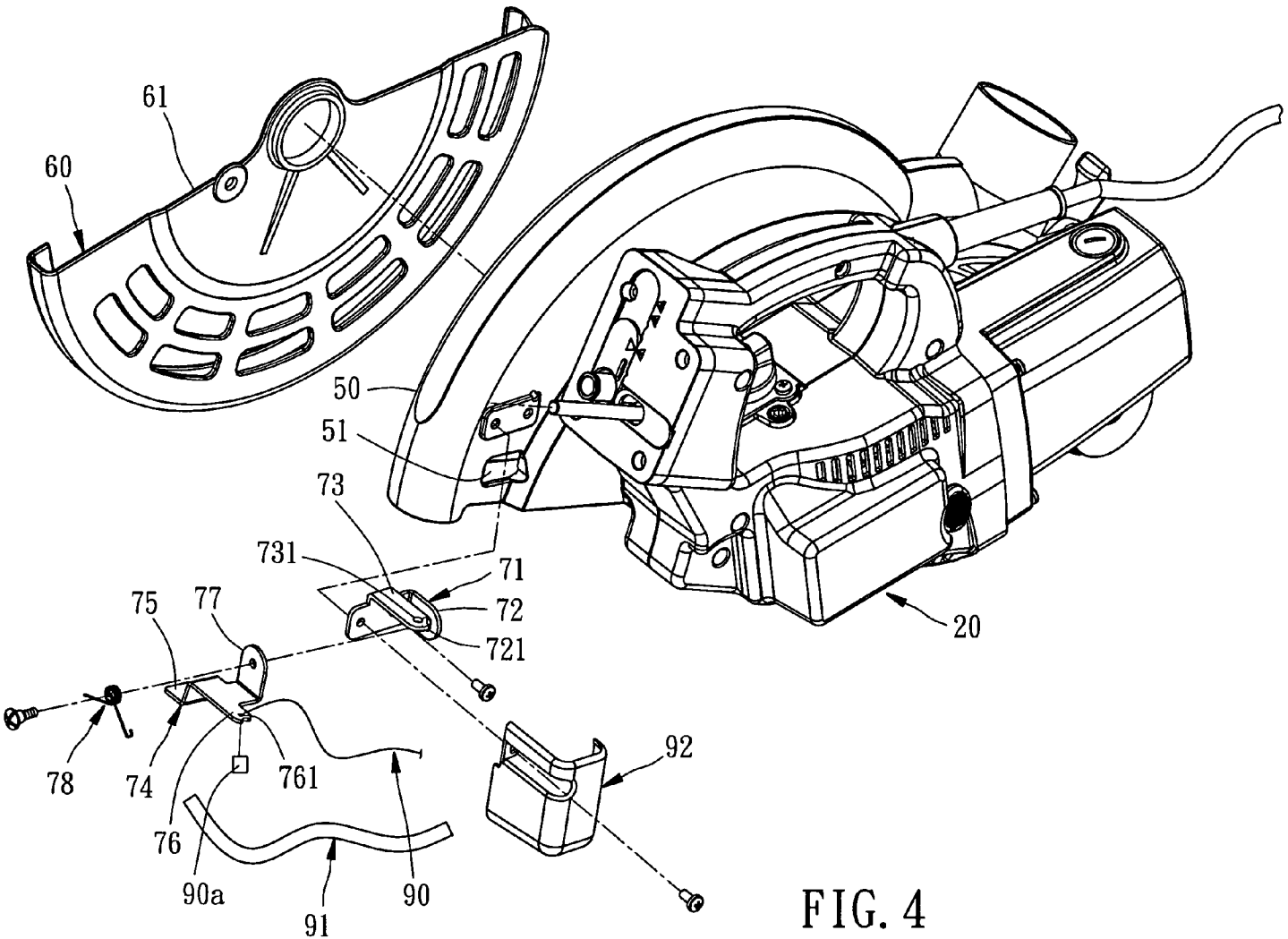
FIG. 4 is an enlarged view of a part of FIG. 3.
Figure 5:
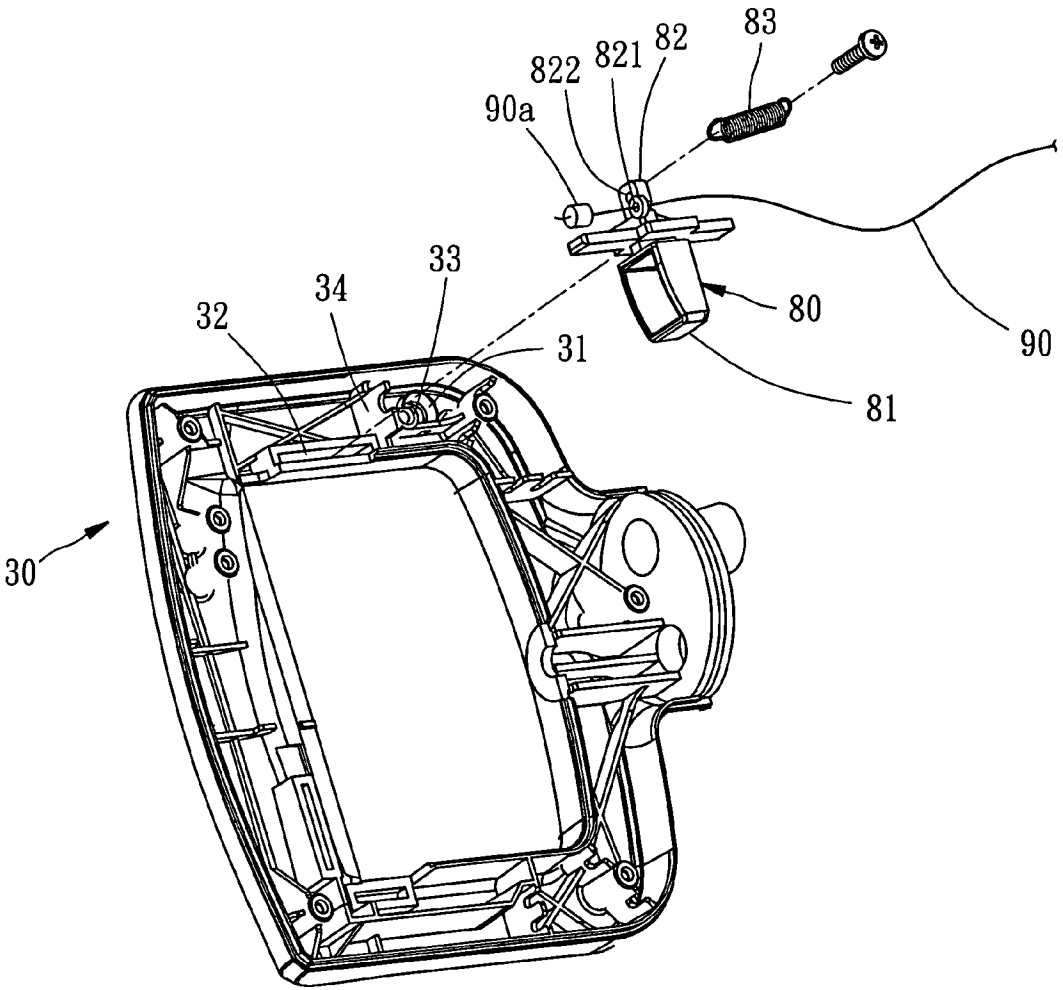
FIG. 5 is another enlarged view of a part of FIG. 3.

Referring to FIGS. 1-3, a miter saw 100 having a securable positioning structure for a blade guard thereof in accordance with a preferred embodiment of the present invention is composed of a bench 10, a blade supporting assembly 20, a rotatable handle 30, a saw blade 40, a stationary blade guard 50, a movable blade guard 60, a positioning unit 70, a control unit 80, and a rope 90.

The blade supporting assembly 20 includes one end pivoted to the bench 10, being pivotable forward and backward with respect to the bench 10.

Figure 10:
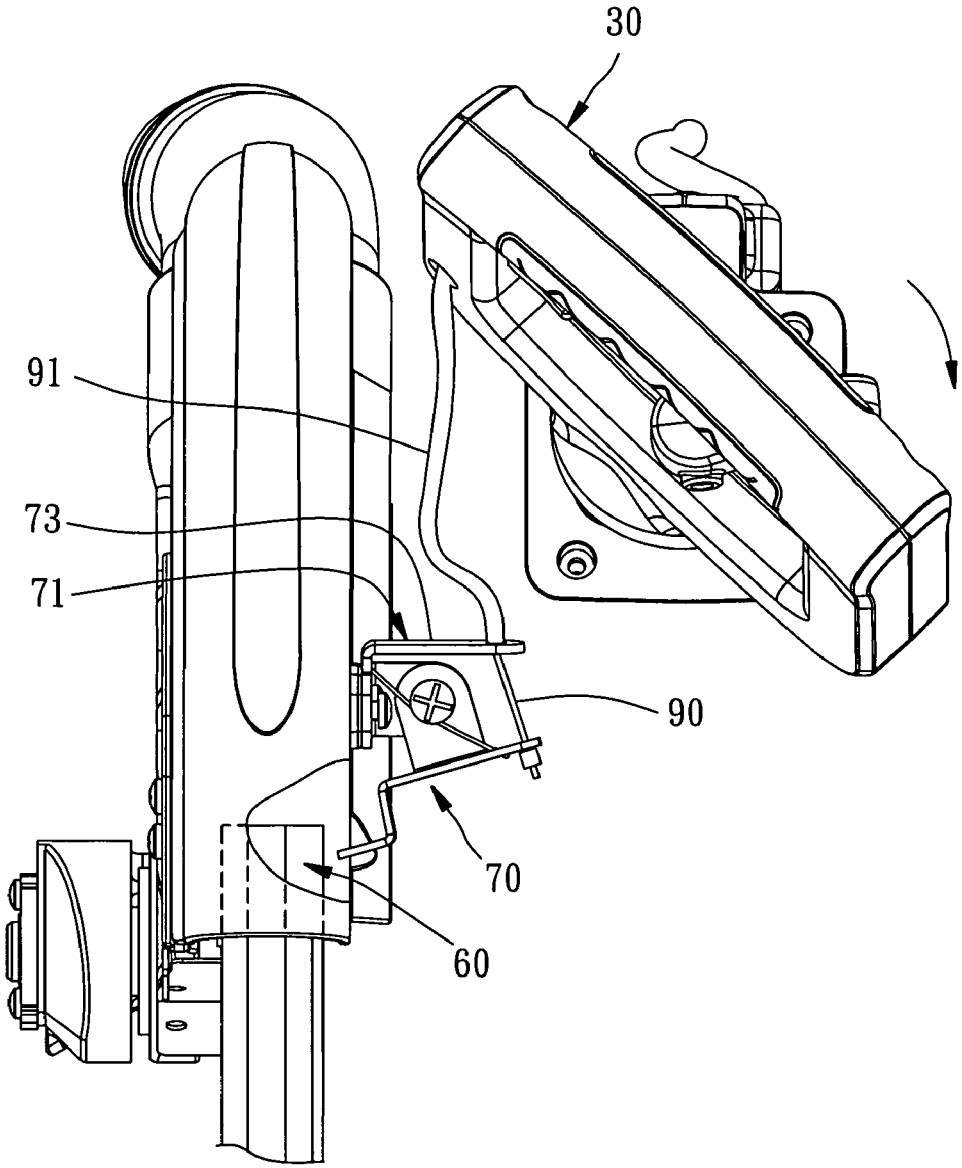
FIG. 10 is similar to FIG. 7, illustrating that the rotatable handle is being operated for rotation.
Figure 11:
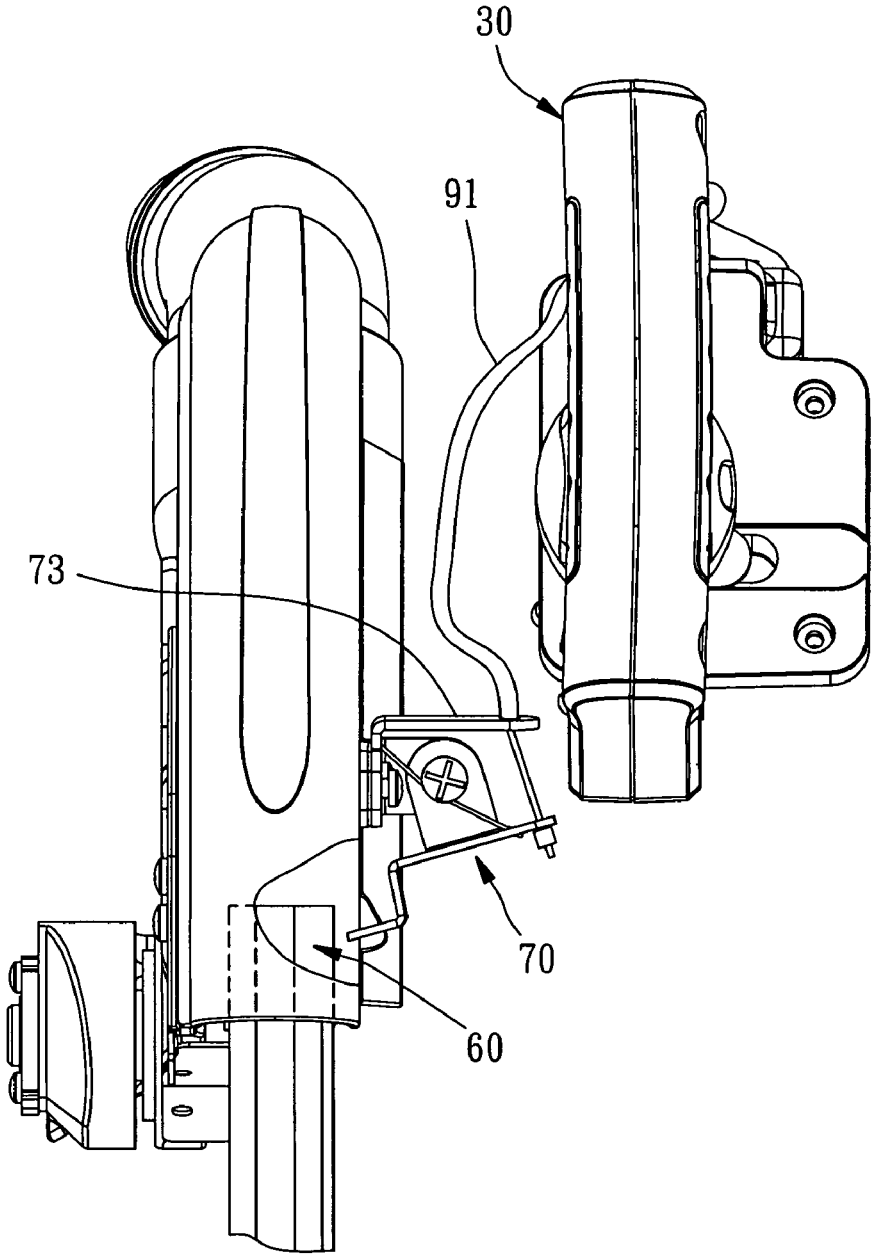
FIG. 11 is similar to FIG. 8, illustrating that the rotatable handle is rotated to a position perpendicular to the bench.

The rotatable handle 30 is rotatably connected with the other end of the blade supporting assembly 20, as shown in FIGS. 10 and 11.

The saw blade 40 is pivoted to one side of the blade supporting assembly 20.

The stationary blade guard 50 is fixedly connected with the blade supporting assembly 20 to cover an upper part of the saw blade 40, having a slot 51 running through one side thereof.

The movable blade guard 60 is shiftable, along with the pivoting movement of the blade supporting assembly 20 with respect to the stationary blade guard 50, between a closed position P1 (FIG. 1) and an opened position P2 (FIG. 2) of a lower part of the saw blade 40.

Referring to FIGS. 3-4 & 7-8, the positioning unit 70 includes a stationary member 71 and a movable member 74. The stationary member 71 is fixed to the stationary blade guard 50, having a first pivot piece 72 and a retaining piece 73. The first pivot piece 72 has a pivot hole 721. The retaining piece 73 has a first retaining hole 731. The movable member 74 is pivoted to the stationary member 71, having a transversal stopping piece 75, a transversal extension piece 76, and an upright second pivot piece 77. The stopping piece 75 has one front end defined as a working portion for the movable member 74. The extension piece 76 has one front end defined as a worked portion for the movable member 74. The stopping piece 75 and the extension piece 76 are jointly movable. The extension piece 76 has a second retaining hole 761. The movable member 74 is pivoted to the first pivot piece 72 via the second pivot piece 77. A biasing member 78, which is a coil spring in this embodiment, is mounted to where the movable member 74 is pivoted to the first pivot piece 72, having two ends, one of which is fixedly stopped against the stationary blade guard 50 and the other is stopped against a front end of the extension piece 76, for providing a biasing force. The stopping piece 75 can be forced by the biasing force to get in the slot 51 of the stationary blade guard 50 and to keep engaging the forced portion 61 of the movable member 60, thus limiting the movable blade guard 60 to the closed position PI to secure safety of the user.

Figure 6:
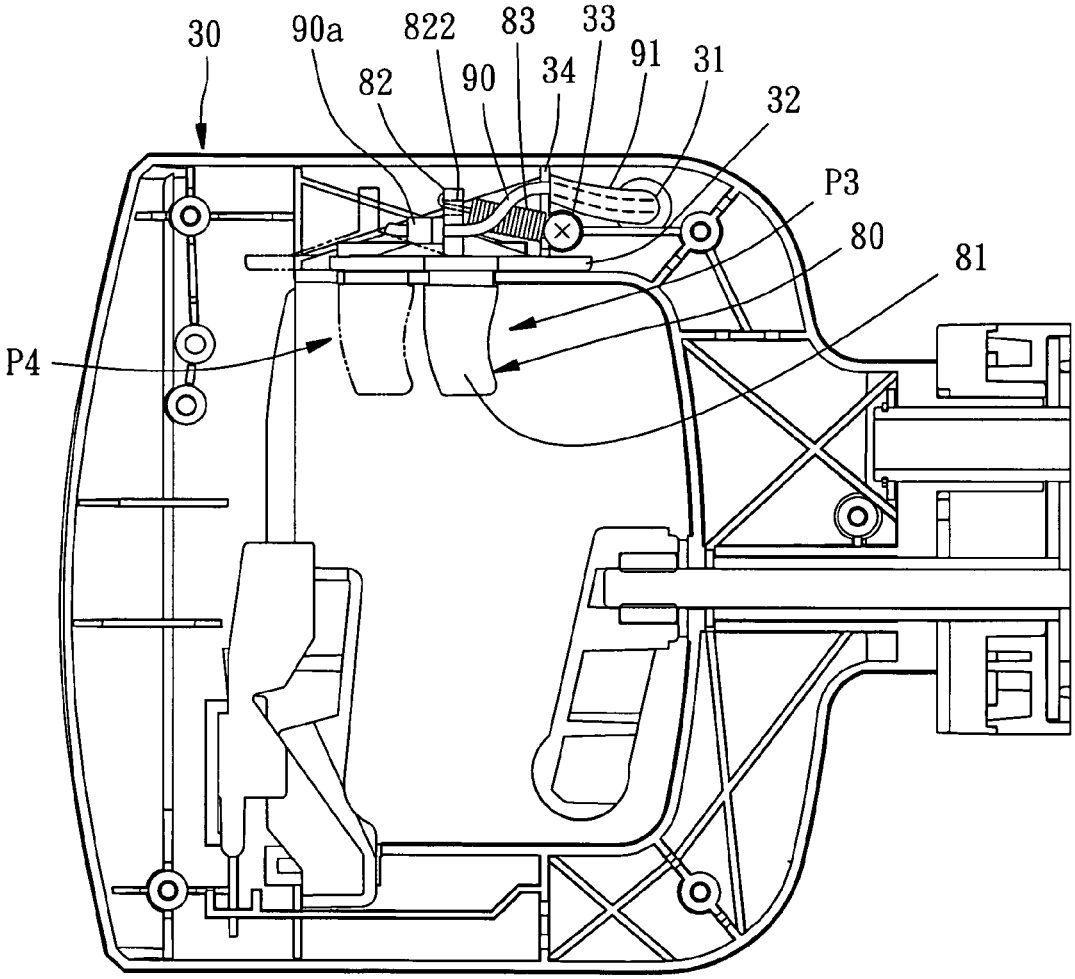
FIG. 6 is a sectional view of the rotatable handle of the preferred embodiment of the present invention, illustrating that the control unit is operated for movement.

When the positioning unit 70 works is done via the control unit 80 and the rope 90. Referring to FIG.6, the rotatable handle 30 includes a through hole 31 and a slide groove 32, internally having a convexity 33 and a retaining portion 34.

The control unit 80 is mounted to the slide grove 32 of the rotatable handle 30. The control unit 80 includes a thumb lotch 81 exposed outside the handle 30, a lug 82 located in the handle 30 and jointly movable with the thumb lotch 81 and having a first through hole 821 and a second through hole 822, and a springy member 83 having two ends connected with the convexity 33 and the second through hole 822 respectively for providing resilience keeping the control unit 80 at a first position P3 shown in FIG. 6. The user can apply a counterforce to the thumb lotch 81 to force it to a second position P4 shown in FIG. 6.

Referring to FIGS. 4-7, the rope 90 passes in sequence through the first through hole 821, the through hole 31, the first retaining hole 731, and the second retaining hole 761, having two ends each fixed to a retaining member 90*a*. The two retaining members 90*a* are stopped against the lug 82 and the extension piece 76 respectively to allow joint movement of the control unit 80 and the positioning unit 70. When the control unit 80 and the positioning unit 70 are jointly moved, the movable member 74 is forced to pivot on the pivot hole 721 and meanwhile to drive movement of the stopping piece 75.

Figure 9:
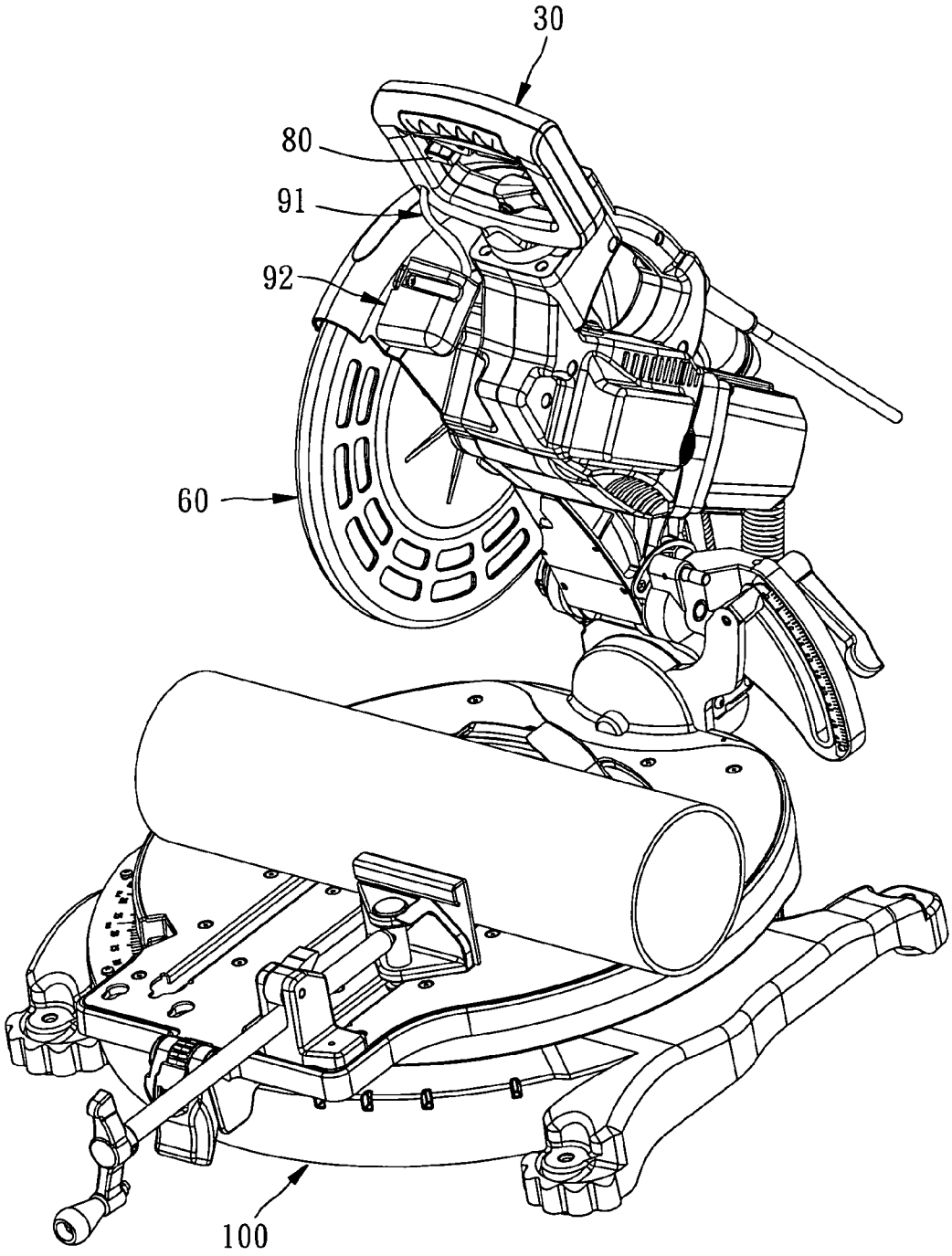
FIG. 9 is similar to FIG. 1, further illustrating the cover shell.

In addition, referring to FIG. 9, the miter saw 100 further includes a flexible guard strip 91 and a cover shell 92. In view of FIGS. 6 and 7 again, the flexible guard strip 91 has two ends, one of which is held by the retaining portion 34 to be fixed in the handle 30 and the other is stopped against the first retaining hole 731. A part of the rope 90 is located in the flexible guard strip 91. The cover shell 92 is fixed to the stationary blade guard 50 to cover the movable blade guard 74, the biasing member 78, and the stationary member 71. In this way, the cover shell 92 and the flexible guard strip 91 jointly shield the rope 90 to prevent it from damage soon incurred by external adverse factors.

Figure 7:
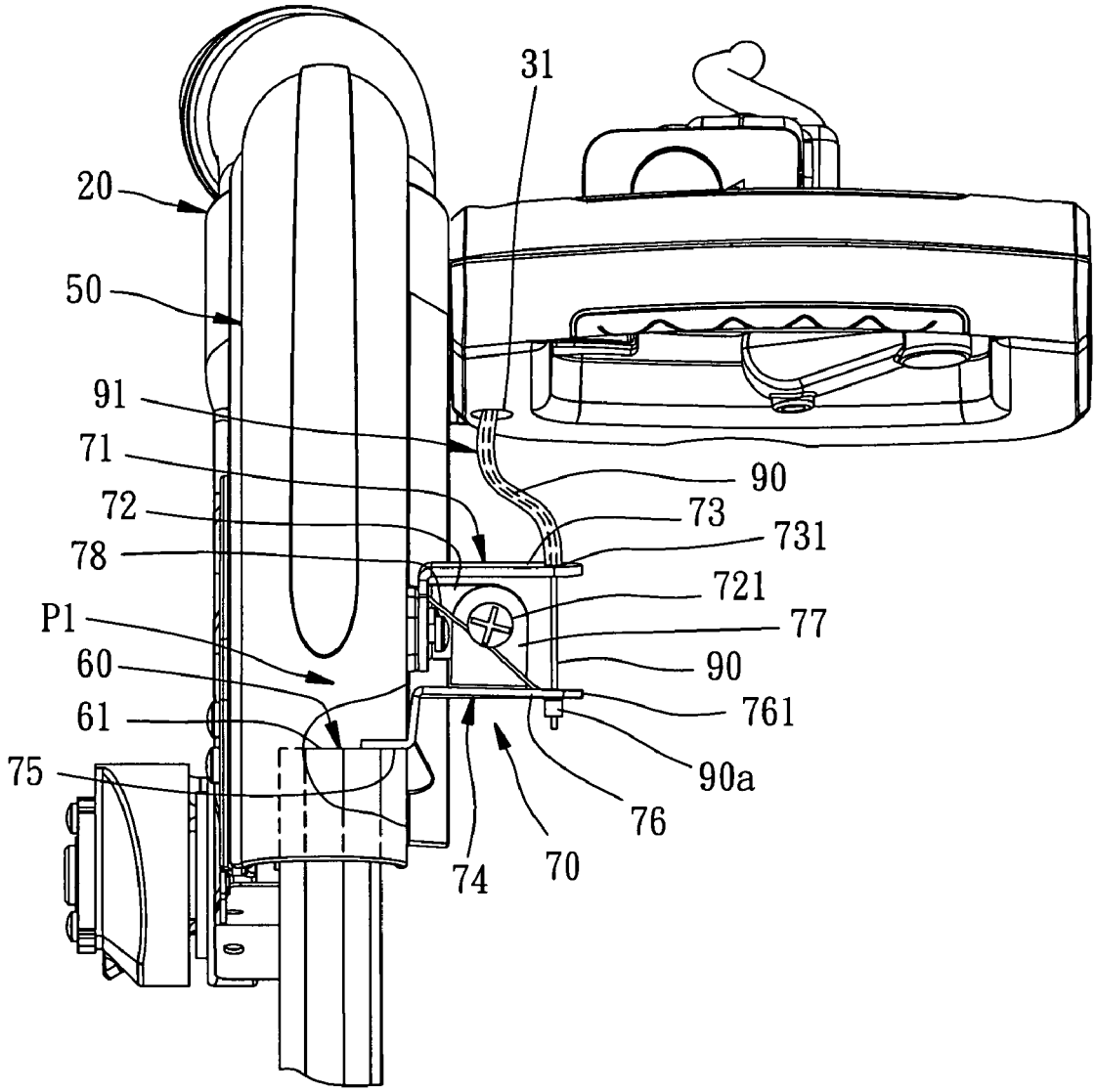
FIG. 7 is a top view of the preferred embodiment of the present invention, illustrating that the stationary member is stopped against the movable blade guard.
Figure 8:
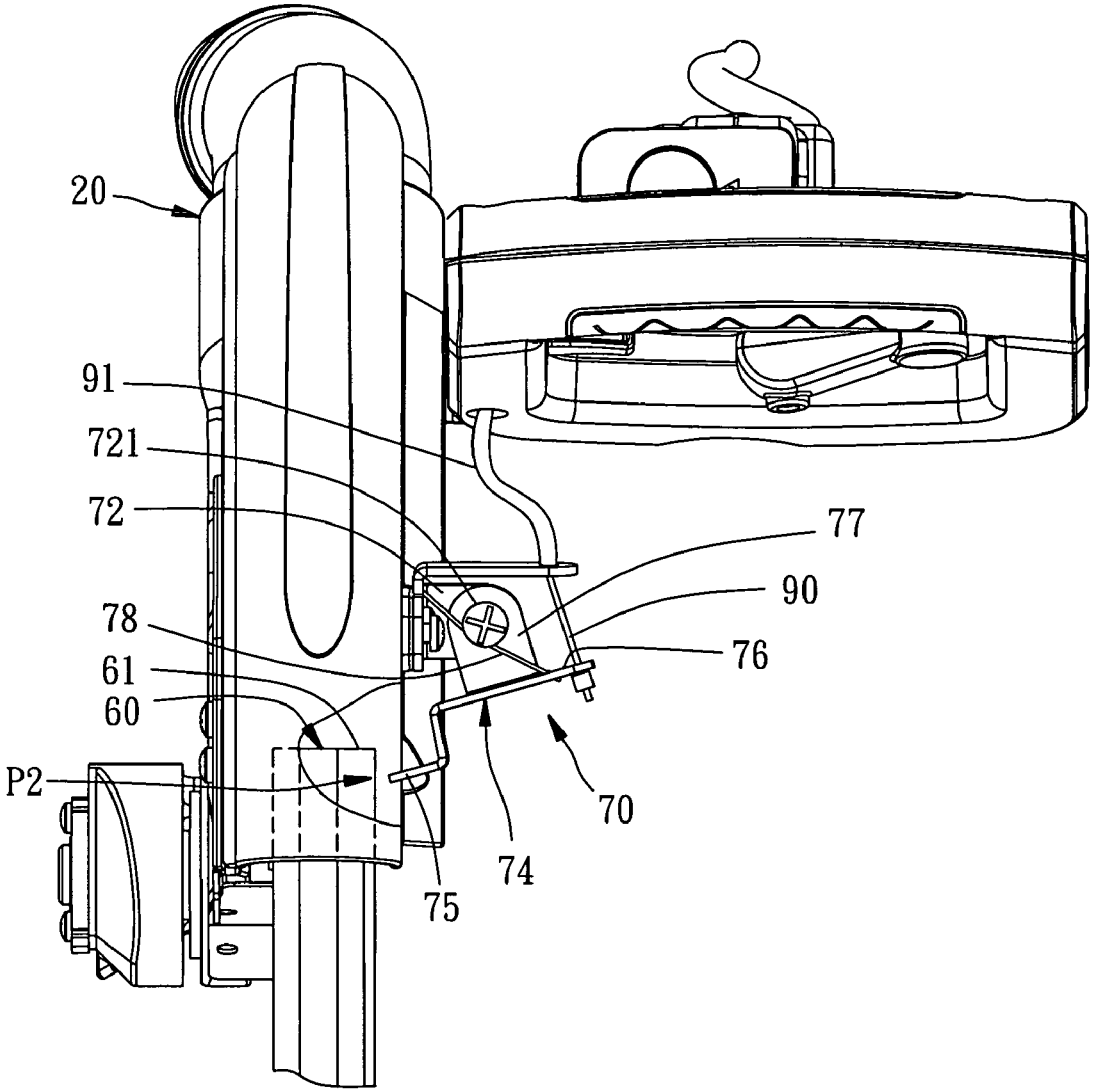
FIG. 8 is another top view of the preferred embodiment of the present invention, illustrating that the stationary member is not stopped against the movable blade guard.

Referring to FIGS. 1 & 6-8 again, the stopping piece 75 is stopped against the forced portion 61 to hold the movable blade guard 60 in position and to cover the lower part of the saw blade 60 without random pivoting movement. Because the movable blade guard 60 is jointly movable with the blade supporting assembly 20 via a linkage (not shown), the movable blade guard 60 held in position disables the user from pressing the blade supporting assembly 20 downward. Therefore, the miter saw 100 of the present invention secures the safety of the cutting operation thereof. In addition, when the user intends to press the blade supporting assembly 20 downward for the cutting operation, the user only needs to push the thumb lotch 81 to shortly jointly move the movable member 74 via the rope 90, thus forcing the stopping piece 75 to shift to where it is not stopped against the forced portion 61, as shown in FIG. 7, from where it is stopped against the forced portion 61, as shown in FIG. 8. In the meantime, the user can press the blade supporting assembly 20 downward, and the movable blade guard 60 is not held in position, so the movable blade guard 60 is forced to jointly move with the linkage (not shown) from the closed position P1 (FIG. 1) to the opened position P2 (FIG. 2) to expose the saw blade 40 for cutting.

It is to be noted that the user can adjust the handle 30 for different angles of exertion to decrease the operational difficulty and to increase the operational convenience, as shown in FIGS. 10 and 11, because different users have different customs of holding the handle 30. In the meantime, the positioning unit 70 is controlled to move to where it is not stopped against the movable blade guard 60. To coordinate with the rotatable handle 30, the rope having a predetermined length is provided for preventing the handle 30 from barrier and for smoothing the operation of the handle 30 while the user adjusts the handle 30. Further, the retaining piece 73 is designed to help hold the flexible guard strip 91, avoiding interference with the action of the handle 30 and the positioning unit 70.

Although the present invention has been described with respect to a specific preferred embodiment thereof, it is no way limited to the details of the illustrated structures but changes and modifications may be made within the scope of the appended claims.

What is claimed is:

1. A miter saw having a securable positioning structure for a blade guard thereof, comprising:

a bench;

a blade supporting assembly having an end pivoted to said bench for forward and backward pivoting movement with respect to said bench;

a rotatable handle rotatably mounted to the other end of said blade supporting assembly;

a saw blade rotatably mounted to a side of said blade supporting assembly;

a stationary blade guard fixedly connected with said blade supporting assembly and covering an upper part of said saw blade;

a movable blade guard shiftable, along the pivoting movement of said blade supporting assembly with respect to said stationary blade guard, between where it covers a lower part of said saw blade and where it does not cover the lower part of said saw blade;

a positioning unit mounted to a side of said stationary blade guard and having a working portion and a worked portion, which are jointly movable;

a control unit mounted to said handle and shiftable between a first position and a second position; and a rope have two ends connected with said control unit and said worked portion respectively;

whereby when said control unit is located at the first position, said working portion is stopped against said movable blade guard to enable said movable blade guard to cover the lower part of said saw blade, and when said control unit is located at the second position, said working portion is not stopped against said movable blade guard.

2. The miter saw as defined in claim 1, wherein said positioning unit comprises a stationary member and a movable member, said stationary member being fixedly mounted to said stationary blade guard, said movable member being pivoted to said stationary member; said working portion and said worked portion are respective two ends of said movable member pivoted to said stationary member.

3. The miter saw as defined in claim 2 further comprising a biasing member mounted to where said movable member is pivoted to said stationary member, wherein said biasing member has two ends, one of which is stopped against said stationary blade guard and the other is stopped against said worked portion of said movable member, said biasing member providing a biasing force keeping said working portion of said movable member close to said movable blade guard.

4. The miter saw as defined in claim 3, wherein said stationary member comprises a transversal first pivot piece and said movable member comprises a transversal stopping piece, a transversal extension piece, and an upright second pivot piece, said second pivot piece being pivoted to said first pivot piece; said working portion and said worked portion are respective front ends of said stopping piece and said extension piece.

5. The miter saw as defined in claim 4, wherein said stationary member comprises a transversal retaining piece having a first retaining hole; said extension piece of said movable member has a second retaining hole formed at a front end thereof said handle has a through hole; said control unit has a thumb lotch and a lug, said thumb lotch being shiftable subject to an external force, said lug and said thumb lotch being jointly movable; said lug having a first through hole; said rope passes through said through hole of said handle and said first retaining hole of said retaining piece, having two ends passing through said first through hole of said lug and said second retaining hole of said extension piece respectively and each being fixedly connected with a retaining member, said retaining members being stopped against said lug and said extension piece respectively.

6. The miter saw as defined in claim 5 further comprising a springy member, wherein said lug of said control unit has a second through hole; said rotatable handle has a convexity formed therein, said springy member having two ends connected with said convexity and said second through hole respectively.

7. The miter saw as defined in claim 5, wherein said stationary blade guard comprises a slot for said working portion of said movable member to get in for contact with said movable blade guard.

8. The miter saw as defined in claim 5 further comprising a flexible guard strip having two ends, one of which is fixed in said rotatable handle and the other is stopped against said first retaining hole of said retaining piece of said stationary member; said rope is located in said flexible guard strip.

9. The miter saw as defined in claim 8 further comprising a cover shell, wherein said cover shell is fixed to said stationary blade guard to cover said movable member, said biasing member, and said stationary member, said cover shell and said flexible guard strip jointly covering said rope.

* * * * *